US005277389A

United States Patent [19]

Ballares et al.

[11] Patent Number: 5,277,389

[45] Date of Patent: Jan. 11, 1994

[54] NO HANDS SHOWER BACK SCRUBBER

[76] Inventors: Virgo V. Ballares, 5071 Cartagena Cir., La Palma, Calif. 90623; Luis A. Ureta, 4871 Wiota St., Los Angeles, Calif. 90041

[21] Appl. No.: 855,563

[22] Filed: Mar. 23, 1992

[51] Int. Cl.[5] ..... F16B 47/00

[52] U.S. Cl. ..... 248/206.3; 428/99; 428/100

[58] Field of Search ..... 248/110, 206.3, 206.4, 248/309.3; 428/99, 100; D6/536

[56] References Cited

U.S. PATENT DOCUMENTS

| | | | |
|---|---|---|---|
| 2,886,839 | 5/1959 | Leopoldi | 15/105 X |
| 3,542,411 | 11/1970 | Filas | 248/363 X |
| 3,601,493 | 8/1971 | Levy | 248/206.4 X |
| 3,677,951 | 7/1972 | Alles | 248/363 |
| 4,047,259 | 9/1977 | Lotis | 15/104.92 |
| 4,704,759 | 11/1987 | Mesa | 15/110 X |

*Primary Examiner*—Henry F. Epstein
*Attorney, Agent, or Firm*—Roth & Goldman

[57] ABSTRACT

A back scrubber to be used in the shower includes a holder which is ordinarily adhered to the shower wall by suction cups and which has a releasable and reversible sponge thereon which can be quickly replaced or used without removing the holder from the wall.

2 Claims, 1 Drawing Sheet

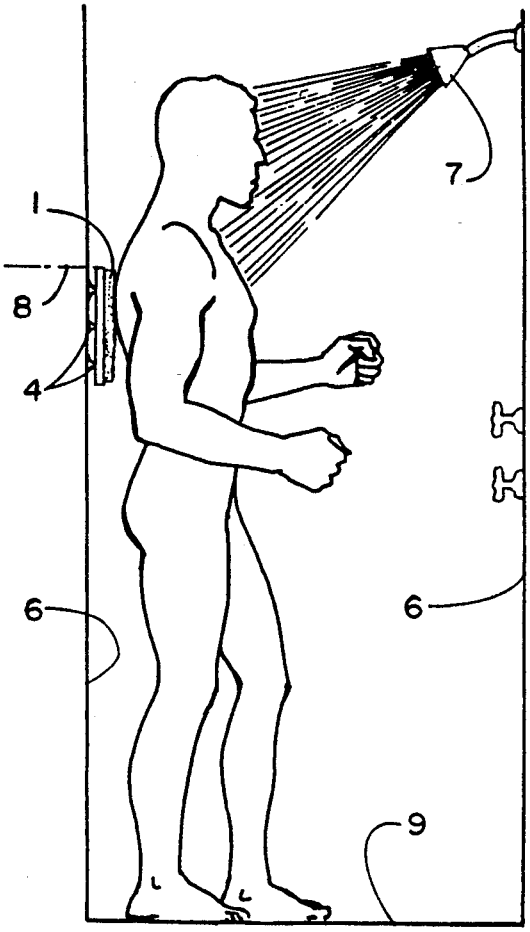
FIG. 1
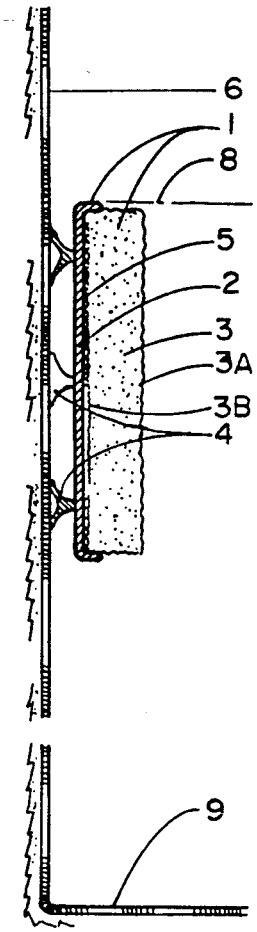
FIG. 2
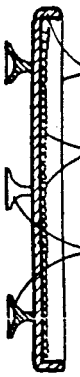
FIG. 3
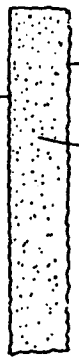
FIG. 4
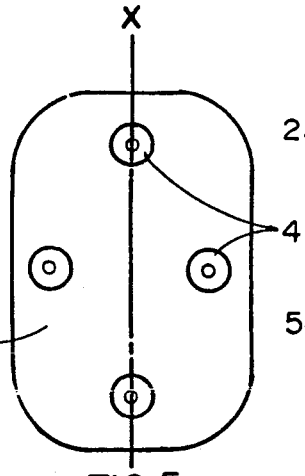
FIG. 5
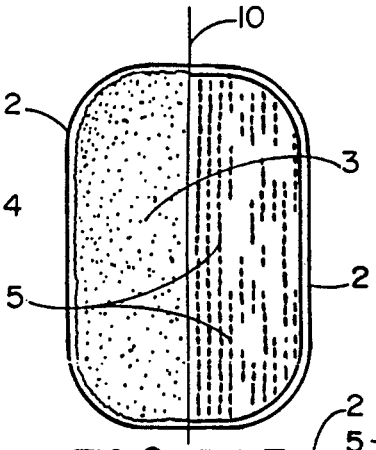
FIG. 6
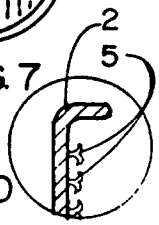
FIG. 7
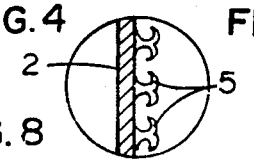
FIG. 8
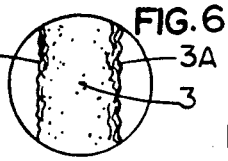
FIG. 9
FIG. 10

NO HANDS SHOWER BACK SCRUBBER

BACKGROUND OF THE INVENTION

This invention relates to a novelty item and at the same time a utility item to be used as back scrubber, while taking a shower, without using your hands or another person to do the scrubbing.

When a person takes a shower, he or she has a problem of cleansing and soap scrubbing his or her back. Some use a back scrubber made of luffa or sponge with wooden or plastic handle or a snappy striped backing with luffa or sponge pads with looped hand-pulls or just a small hand towel to soap scrub their back. It is hard work and very inefficient. You may even pull your back muscle doing it.

The present invention is a personalized back scrubber. The housing, in any geometrical shape is made of plastic or of other similar material formed by injection molding or by other similar process. It has a replaceable super absorbent sponge attached to the housing using series of lines of small hook elements holding it firmly stable. The housing, with several suction discs made of plastic or rubber or of other similar material, is attached to the shower wall by pressing the housing with enough pressure to hold the housing firmly to the wall by suction. The user locates and adjusts the back scrubber to a position and height most comfortable to scrub his or her back at the right places with up and down, left to right movement of the back and body, at the same time control the pressure desired. Liquid bath soap may be applied on the sponge before using it. Even hard to reach portions of the back can be scrubbed, deep cleaning away dirt and excess oil, keeping the skin pores clean and smoother, which may improve blood circulation and making a person feel invigorated and tingly clean.

The housing has at least four suction discs on one side and on the other side, it is filled up with series of lines of small hook elements, enough to receive and hold the replaceable sponge firmly stable to the housing. The sponge has two kinds of scrubbing surfaces—regular and rough and is reversible. It can be cleaned, rinsed thoroughly and air-dried, so it will not grow mildew and bacteria. The sponge may be replaced every two to three months for maximum efficiency. The rough surface of the sponge will have different individual colors, so each member of the family and guests may have his or her own personalized color sponge to use exclusively for sanitary reasons. The housing is removable and transferable and may be replaced only when the suction discs fails to stick firmly to the wall.

SUMMARY OF THE INVENTION

The principal purpose of this invention is to provide a shower back scrubber, which a person may use when he or she is alone taking a shower. With this back scrubber, anyone can scrub his or her back without using their hands. The user can locate and adjust the back scrubber to a position and height most comfortable to scrub his or her back at the right places with up and down, left to right movement of the back and body, with desired pressure. Liquid soap may be applied on the sponge before using the scrubber. The replaceable sponge has two kinds of scrubbing surfaces—regular and rough and is reversible. The rough surface have different individual colors for personalized use of every member of the family and guests for sanitary reasons.

The housing in any geometrical shape, where the sponge is attached, is made of plastic or of other similar material, formed by injection molding or by other similar process. It has at least four suction discs made of plastic or rubber or of other similar material attached on one side of the housing, the purpose of which is to firmly attach the housing to the shower wall. On the other side of the housing within the perimeter rim is a series of lines of small hook elements that receive and hold the replaceable sponge. The housing is removable and transferable and may be replaced only when the suction discs fail to stick firmly to the wall.

BRIEF DESCRIPTION OF THE DRAWINGS

FIG. 1 is a pictorial view of a person using the back scrubber of the present invention in a shower.

FIG. 2 is a cross sectional elevation of the back scrubber shown in FIG. 1 affixed to a shower wall.

FIGS. 3 and 4 respectively comprise a cross sectional elevation of the back scrubber housing and of the scrubber sponge, FIG. 5 comprises a rear elevation of FIG. 3.

FIGS. 6 and 7 comprise a front elevation of FIG. 4.

FIG. 8 comprises an enlarged view of means for fastening the sponge to the housing.

FIG. 9 is an enlarged view of a sponge.

FIG. 10 is an enlarged detail of the housing corner.

DETAILED DESCRIPTION OF THE INVENTION

This invention is composed of two parts—the housing and the replaceable sponge. The housing, in any geometrical shape with rounded corners, is made of plastic or of other similar material, formed by an injection molding process or by other similar process. It has several suction discs on one side for sticking the housing firmly stable to the shower wall and on the other side, series of lines of small hook elements within the housing rim to receive and hold the replaceable sponge firmly stable to the housing.

The replaceable sponge is made of super absorbent sponge or other similar material, with two kinds of scrubbing surfaces—regular and rough. The rough surface have different individual colors, so every member of the family and guests may have his or her own personalized color sponge to use exclusively for sanitary reasons.

The back scrubber is attached to the shower wall, with location and height being adjustable to meet the user's preference. Before using the scrubber, liquid soap may be applied on the replaceable sponge. The user positions his or her body with back against the scrubber and with up and down, left to right movement of the body or back and with controlled pressure, scrubs his or her back at the right places, deep cleaning away dirt and excess oil, keeping skin pores clean, which may improve blood circulation, making the person feel invigorated and tingly clean. The replaceable sponge can be cleaned, rinsed thoroughly and air-dried to prevent mildew build-up and bacteria growth. It is replaceable every two to three months for maximum efficiency. The housing portion is re-usable, movable and transferable and may be replaced only when the suction discs do not stick well to the shower wall.

Although the description above contain many specificities, these should not be construed as limiting the scope of the invention, but merely providing illustrations of some of the presently preferred embodiments. Thus, the scope of the invention should be determined by the appended claims and their legal equivalents, rather than by the examples given.

We claim:

1. A shower back scrubber device comprising:

a) a housing having a wall with a plurality of suction cups on a first side thereof for attaching said housing to a shower wall and a plurality of hooks on a second side of said housing wall, said second side facing away from said first side, and b) a sponge having a first scrubbing surface and a second scrubbing surface which is relatively rough compared to said first scrubbing surface, said first and said second scrubbing surfaces each being capable of releasably retaining said sponge on said hooks whereby said sponge may be reversed or replaced on said housing without removing said housing from said shower wall.

2. The shower back scrubber of claim 1, in combination with additional replaceable sponges, each one of said sponges having a contrasting color for visually distinguishing each of said sponges from each other.

* * * * *